United States Patent [19]

Regent

[11] Patent Number: 4,610,376

[45] Date of Patent: Sep. 9, 1986

[54] BULK STORAGE CONTAINERS

[75] Inventor: Robert M. Regent, Hepworth, England

[73] Assignee: A. O. Smith Harvestore Products, Inc., Arlington Heights, Ill.

[21] Appl. No.: 569,170

[22] Filed: Jan. 9, 1984

[30] Foreign Application Priority Data

Jan. 10, 1983 [GB] United Kingdom ..... 8300546

[51] Int. Cl.[4] ..... B67D 5/06

[52] U.S. Cl. ..... 222/185; 403/310; 220/5 A

[58] Field of Search ..... 222/173, 460, 462, 185, 222/180, 181; 403/310, 312; 14/14; 220/80, 5 A, 1.5

[56] References Cited

U.S. PATENT DOCUMENTS

| | | | |
|---|---|---|---|
| 87,741 | 3/1869 | White | 14/14 |
| 784,265 | 3/1905 | Ingoldsby et al. | 14/14 |
| 2,353,039 | 7/1944 | Janiszewski | 14/14 |
| 3,246,788 | 4/1966 | Meyer | 220/5 A |
| 3,602,400 | 8/1971 | Cooke | 222/460 |
| 3,742,664 | 7/1973 | Reding | 222/185 |

FOREIGN PATENT DOCUMENTS

| | | | |
|---|---|---|---|
| 30254 | 12/1919 | Norway | 14/14 |

*Primary Examiner*—Joseph J. Rolla
*Assistant Examiner*—Kenneth Noland
*Attorney, Agent, or Firm*—Andrus, Sceales, Starke & Sawall

[57] ABSTRACT

A bulk storage container (10) has a cylindrical body section (12) joined at its lower end to a tapering conical section (14) which terminates in an outlet (16) for the container. A cylindrical skirt section (18) of the same diameter as the body section (12) surrounds the conical section (14). The body section (12), the conical section (14) and the skirt section (18) are joined by way of a plurality of joint members (50) arranged side by side around the periphery of the container (10). Each joint member (50) has first attachment devices (52) for attachment to the body section (12), second attachment devices (60) for attachment to the conical section (14) and third attachment devices (56) for attachment to the skirt section (18). The first and third attachment devices (52,56) are vertically spaced so that the supporting force for the body section (12) is transmitted through the joint members (50). The second attachment devices (60) are vertically located between the first and third attachment devices.

5 Claims, 11 Drawing Figures

BULK STORAGE CONTAINERS

BACKGROUND OF THE INVENTION

This invention relates to bulk storage containers of the type known as silos and to the securing of cone or hopper type discharge units at the bottom of such silos.

Silos of vertical generally cylindrical construction are well-known for the storage of industrial or agricultural materials though they can also be used for the storage of fluids generally. A simple method of unloading such a silo is to provide it at its lower end with a cone-shaped section which narrows down from the full diameter of the silo to a much smaller diameter where a suitable door or gate can be located to control the outward flow of materials.

To ensure even emptying of the silo it is desirable for the silo to have a smooth inner surface throughout and particularly at the point where the cone meets the bottom of the main body section of the silo. However, there are circumstances where it would be preferred to provide the silo with a skirt surrounding the cone of a diameter the same as that of the silo body.

It is an object of the invention to provide a bulk storage container having a smooth inner surface throughout and which is capable of being fitted with a skirt having the same diameter as the body of the container.

It is a further object of the invention to provide an improved joint member for use in the construction of such a container.

SUMMARY OF THE INVENTION

In a first aspect, the invention provides a bulk storage container comprising:

a body section of vertical generally-cylindrical shape;

a tapering conical section joined to said body section at the lower end thereof;

outlet means at the lower end of said tapering conical section;

a skirt section around said co-ical section and of the same dimaeter as said body section; and a plurality of joint members arranged side by side around the periphery of said body section to join said body section to said tapering conical section and to said skirt section; each said joint member including:

(a) first attachment means for attachment to said body section;

(b) second attachment means for attachment to said tapering conical section; and (c) third attachment means for attachment to said skirt section;

said first and third attachment means being spaced from one another in a vertical direction whereby the supporting force for said body section is transmitted through said joint member and said second attachment means being located in a vertical direction between said first and third attachment means.

In a second aspect, the invention provides a joint member for use in a bulk storage container, the joint member comprising:

(a) first attachment means for attachment to said body section;

(b) second attachment means for attachment to said tapering conical section; and (c) third attachment means for attachment to said skirt section;

said first and third attachment means being spaced from one another in a vertical direction whereby the supporting force for said body section is transmitted through said joint member and said second attachment means being located in a vertical direction between said first and third attachment means.

BRIEF DESCRIPTION OF THE DRAWINGS

The invention will be described in more detail, by way of example, with reference to the drawings, in which.

DETAILED DESCRIPTION OF PREFERRED EMBODIMENTS

Figure 1:
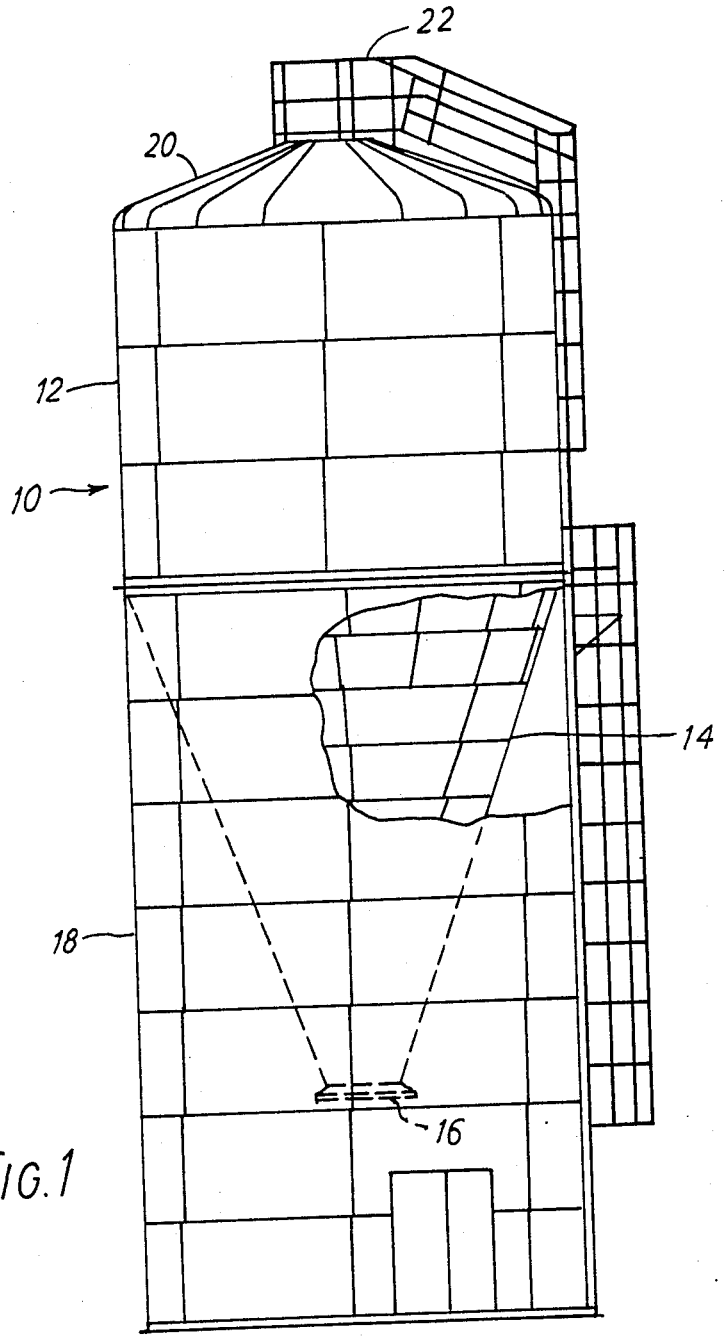
FIG. 1 is an elevational view of a tower silo provided with a cone unloader and having a skirt.

An agricultural or industrial bulk storage silo 10 is shown in FIG. 1 to consist of a body section 12 which is of vertical cylindrical shape, a tapering cone section 14 which is secured to the lower end of the body section and terminates in an outlet 16 for the silo, and a skirt 18 which surrounds and protects the region of the cone 16 and also provides the support for the body section 12. The silo illustrated is assumed to be of glass lined construction, that is to say it is fabricated from steel plates which have a glass layer fused to their surfaces. The plates are bolted together and all joints are sealed with an appropriate mastic. The silo has a roof 20 which may be of similar construction and which carries suitable loading equipment 22 of conventional type.

The angle of inclination of the sloping surface of the cone as shown in FIG. 1 is 70 degrees. However, the angle may vary upwardly or downwardly, depending on the material to be stored. Typical diameters for the container would be in the range 10 to 30 feet (3 to 9 m).

Figure 2:
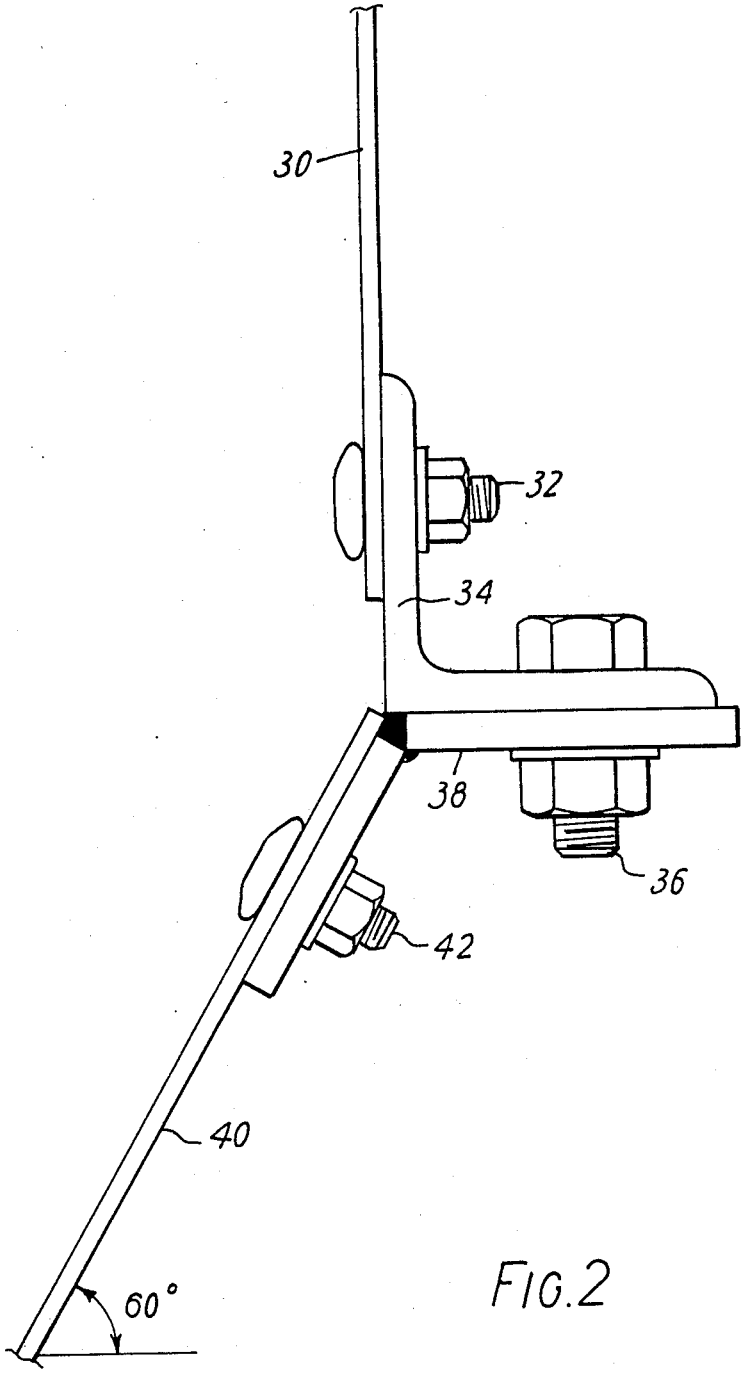
FIG. 2 illustrates one known way of securing the cone in a stilt-mounted silo.
Figure 3:
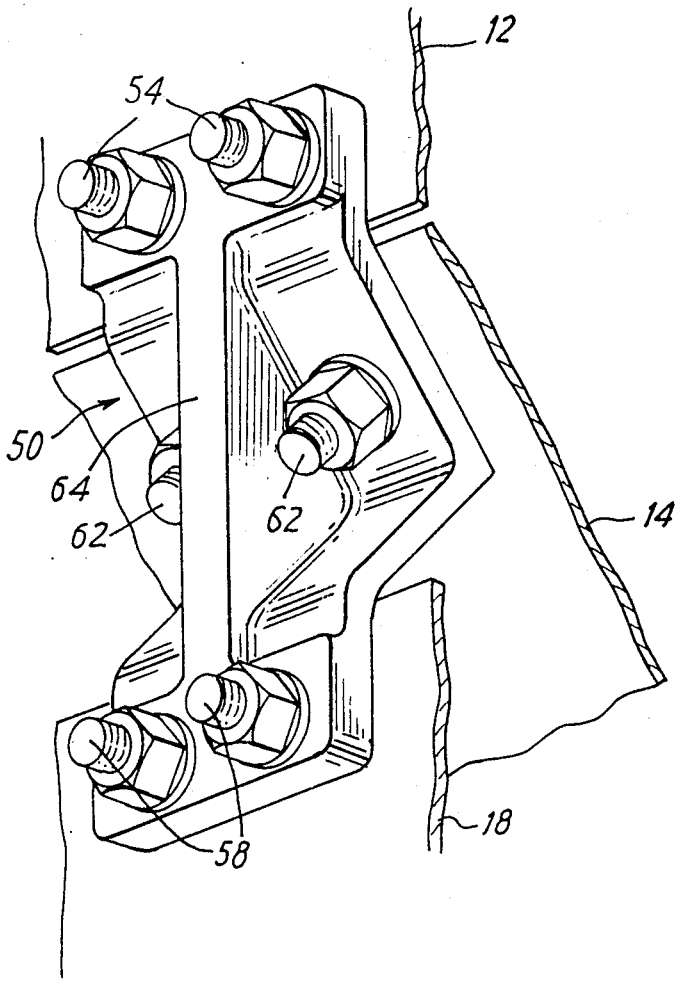
FIG. 3 is a perspective view of the joint member in a first silo embodying the invention.
Figure 6:
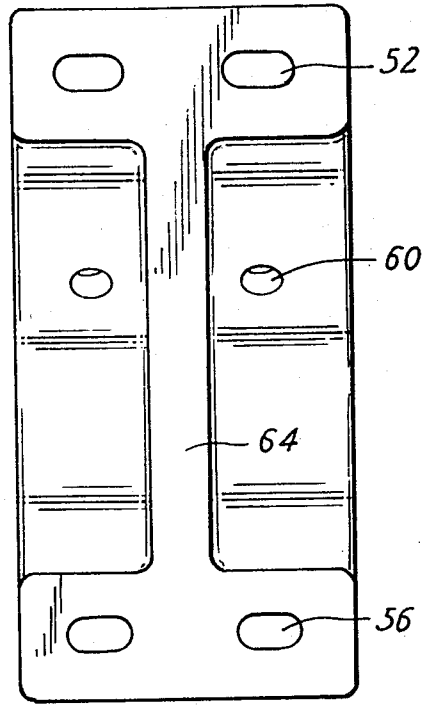
FIGS. 4, 5, 6 and 7 are respectively front, side sectional, rear and top views of the joint member of FIG. 3.

FIG. 2 shows how the cone section may be joined to the body section in a stilt-mounted silo, i.e. one without a skirt. In this instance the body section 30 is bolted by bolts 32 to an angle member 34. To the horizontal limb of the angle member 34 is bolted by bolts 36 a rolled angled flange 38 which is of welded construction and has a 120 degree angle (as shown) and extends around the periphery of the container in a small number of sections of typically 9 feet (2.7 m) length. The cone section 40 is then secured to the inwardly inclined part of the flange 38 by further bolts 42. As mentioned, this structure is supported on stilts or columns which carry the angle member 34. There are however problems in adapting the structure to enable the provision of a skirt. The bolts 42 which secure the cone to the flange stand in the way of the skirt, particularly where the cone has a steep angle of inclination of say 60 degrees or greater. As it is essential to maintain a smooth inner surface to the silo it is not possible to provide a skirt of precisely the same diameter as the body section 30. This means that if a skirt of slightly different diameter is used there will be substantial bending moments stressing the structure at this point. Furthermore, the manufacture of the heavy angle sections 34 and 38 is relatively expensive as they have to be curved to fit around the periphery of the silo.

Thus, in accordance with this invention, the silo of FIG. 1 is perferably provided with a plurality of joint members 50 as illustrated in FIGS. 3 to 8. These joint members 50 are forged or cast and are about 5 inches (125 mm) wide in the circumferential direction and about 10 inches (260 mm) high. Each member 50 may be essentially flat or may be curved to conform with the periphery of the silo and sufficient members are placed side-by-side to extend around the silo.

Figure 5:
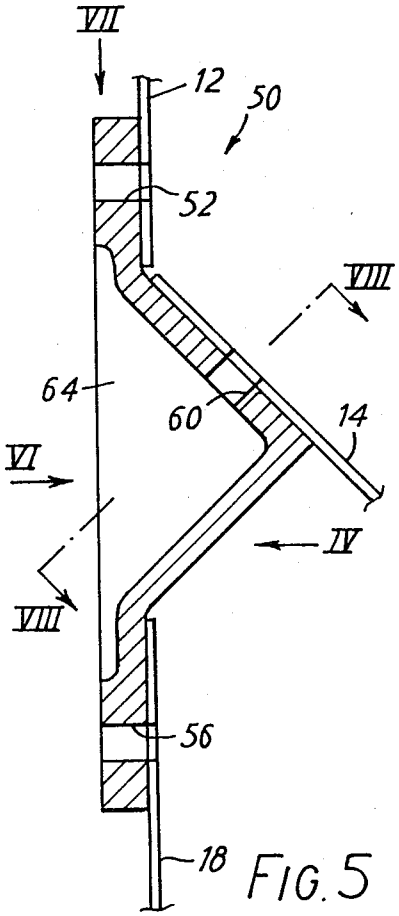
Figure 4:
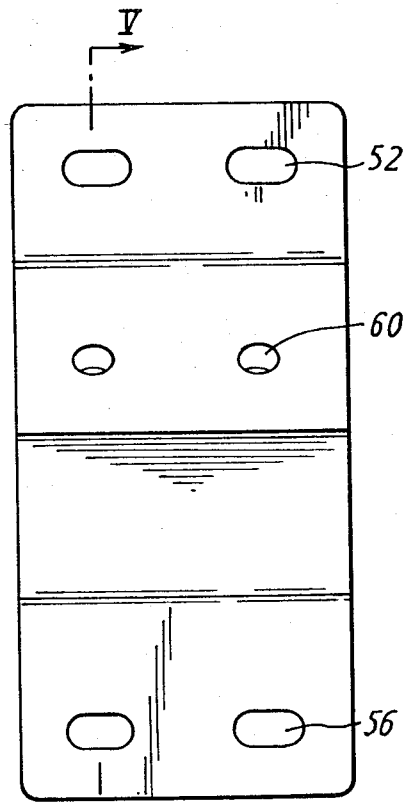

Each member 50 has two upper bolt holes 52 for attachment to the body section 12 by bolts 54, two lower bolt holes 56 for attachment to the skirt 18 by bolts 58, and two inclined bolt holes 60 for attachment to the cone 14 by bolts 62. The bolts 54 and 62 have mushroom-shaped heads within the silo to provide as smooth a surface as possible. The front surface (i.e. the inner surface in the silo) is formed with an inwardly-inclined surface portion containing the bolt holes 60 on which the periphery of the cone 14 rests, as indicated in FIG. 5. Behind this portion there is a radially-extending rib 64 providing strength and rigidity to the member and carrying the weight of the body section 12 through the member 50 to be supported by the skirt 18.

In this way the fixings to the body section and the cone are vertically separated leaving plenty of room for the bolts 62, while at the same time maintaining the required smooth inner surface to the silo. The top end of the cone 14 is very close to the bottom end of the body section and the small gap is easily filled by a mastic material. The skirt is directly under the wall of the body section 12 which reduces stresses and makes for easier assembly of the silo. The same junction members 50 can be used for various different silo diameters, thus eliminating the need for a variety of parts. Because of the ready availability of the bolt holes additional circumferential stiffening in the form of rolled angles or channels can easily be added to the external periphery of the structure.

The same joint members 50 can indeed be used where there is no skirt but where the silo is stilt mounted. In this instance, a rolled angle member is bolted around the silo using the lower bolt holes 56, and the top of the stilt members or legs also secured at this point. The legs then stand slightly outside the diameter of the body of the silo.

Figure 7:
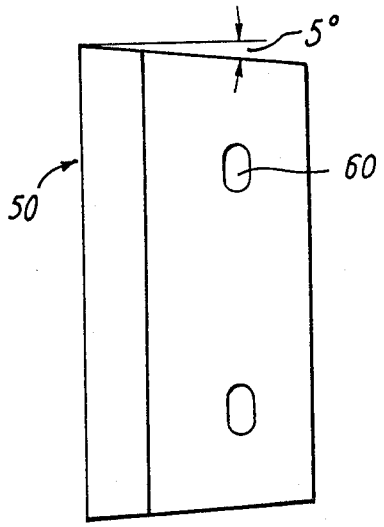
Figure 8:
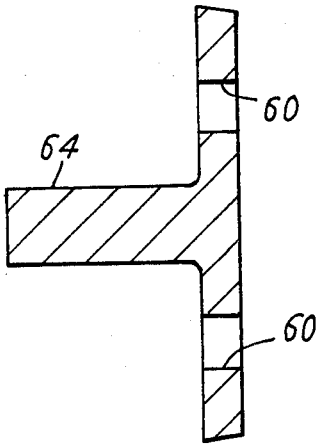
FIG. 8 is a section taken on the line VIII—VIII in FIG. 5.

As seen in the plan view of FIG. 7, the members 50 are provided with a 5 degree taper on each of their side edges to avoid interference when they are in position around the circumference of the silo.

Figure 11:
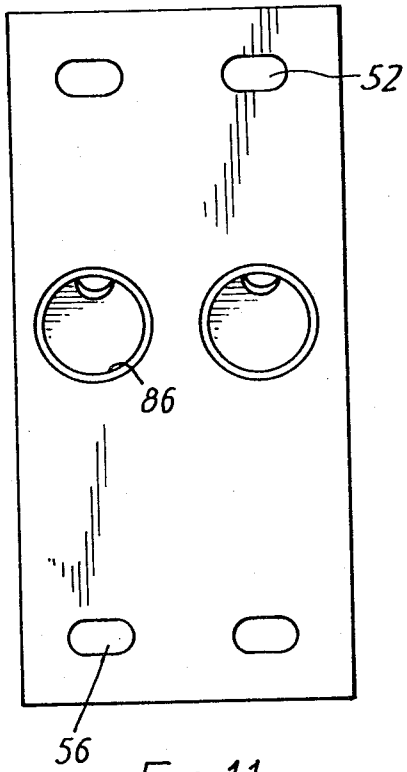
FIGS. 9, 10 and 11 are respectively front, side and rear views of an alternative form of the joint member.
Figure 10:
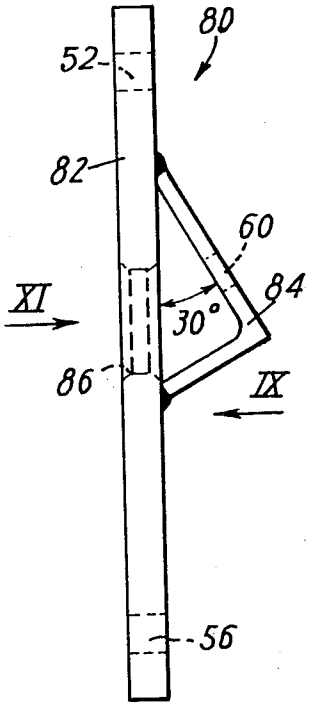
Figure 9:
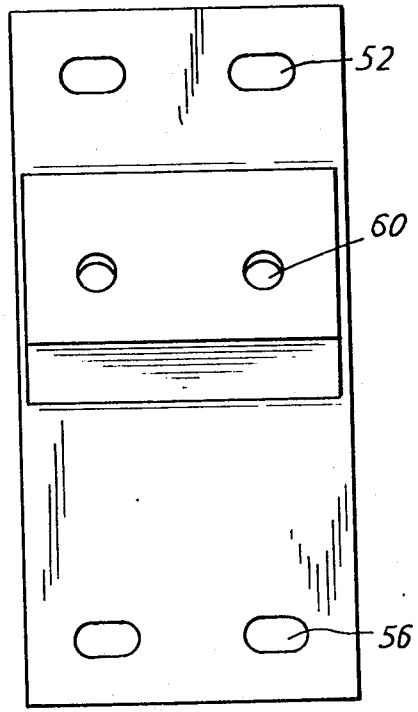

FIGS. 9 to 11 show a second type of joint member which is fabricated by welding rather than being forged or cast. In this case the joint member 80 is formed of a plate 82 carrying the apertures 52 and 56 and an angle section 84 welded to it and carrying the apertures 60. Further large apertures 86 are provided in the plate to give plenty of room for the bolts securing the top edge of the cone in the bolt holes 60. The members 80 of FIGS. 9 to 11 have the advantage that the weight of the body section is supported in direct line through the plate 82.

It will be appreciated that various modifications may be made to the examples described and illustrated. In particular, while each joint member 50 is shown as having two bolt holes at each horizontal level, the number of bolt holes is not restricted to two. In another modification each joint member may be provided with a lug to overlap the adjacent joint member. The lug is provided with a bolt hole so that the members can be bolted together by one of the bolts 52, 56, 60. In this way additional rigidity is provided around the periphery of the structure at this point.

What I claim is:

1. A bulk storage container comprising:

a body section of vertical generally-cylindrical shape;

a tapering conical section adapted to be joined to said body section at the lower end thereof;

outlet means at the lower end of said tapering conical section;

a separate skirt section around said conical section and the same diameter as said body section; and said skirt section extending downwardly of said outlet means and constructed and arranged to support the container in a vertical operating position, and a plurality of joint members arranged side by side around the periphery of said body section and mounting said body section on said skirt section so as to be spaced vertically above said skirt section;

each said joint member including:

(a) first attachment means connected to said body section;

(b) second attachment means vertically spaced from said first attachment means and connected to said skirt section whereby the supporting force of the body section is transmitted through said joint members; and (c) third attachnent means connected to said conical section to secure it to said body section; said third attachment means being located between said first and second attachment means and accessible from the exterior of the container with the joint member connected to the body section and the skirt section.

2. The container according to claim 1, wherein said joint member includes an upper vertically-extending portion, a lower vertically-extending portion in line with said upper vertically-extending portion and an inwardly-inclined portion intermediate said upper and lower vertically-extending portions; said first and second attachment means being formed in said upper and lower vertically-extending portions respectively and said third attachment means being formed in said intermediate inwardly-inclined portion.

3. The bulk storage container of claim 1 wherein each of said joint members includes an upper plate portion and a bottom plate portion connected by an integral inwardly extended V-shaped portion, said upper and bottom plate portions being in the same plane, said first and second attachment means located in said upper and lower plate portions and said third attachment means located in said V-shaped portion.

4. In a bulk storage container having:

a body section of vertical generally-cylindrical shape;

a tapering conical section adapted to be joined to said body section at the lower end thereof;

outlet means at the lower end of said tapering conical section;

a separate skirt section around said conical section and of the same diameter as said body section; and a plurality of joint members arranged side by side around the periphery of said body section and mounting said body section on said skirt section so as to be spaced vertically above it;

each said joint member including:

(a) a first attachment bolts releasably attached to said body section;

(b) a second attachment bolts releasably attached to said skirt section whereby the supporting force for the body is transmitted through said joint members; and (c) a third attachment bolts releasably attached to said conical section to secure said conical section to said body section; said third attachment bolts means being vertically located between said firat and second attachment means and accessible from the exterior of the container when the body section is mounted on the skirt.

5. The container according to claim 4, wherein said joint member includes an upper vertically-extending portion, a lower vertically-extending portion in line with said upper vertically-extending portion and an inwardly-inclined portion intermediate said upper and lower vertically-extending portions; said first and second bolts located in said upper and lower vertically-extending portions respectively and said third bolt being located in said intermediate inwardly-inclined portion.

* * * * *